US005558801A

United States Patent [19]

Tsukahara et al.

[11] Patent Number: 5,558,801

[45] Date of Patent: Sep. 24, 1996

[54] CASTING STALK

[75] Inventors: Mikio Tsukahara, Inba-gun; Noboru Ohishi, Aki-gun; Hisao Taguchi, deceased, late of Atsugi, all of Japan, by Noriko Taguchi, personal representative

[73] Assignees: Nichias Corporation, Tokyo; Ohta Kasei Corporation, Yokohama, both of Japan

[21] Appl. No.: 251,927

[22] Filed: Jun. 1, 1994

[30] Foreign Application Priority Data

Jun. 1, 1993 [JP] Japan ..... 5-034847 U

[51] Int. Cl.[6] ..... B22D 18/04; B22D 41/50

[52] U.S. Cl. ..... 222/607; 164/306; 266/236

[58] Field of Search ..... 164/306, 309, 164/119, 337, 437; 266/236; 222/606, 607

[56] References Cited

U.S. PATENT DOCUMENTS

| | | | |
|---|---|---|---|
| 2,674,019 | 4/1954 | Rossi et al. | 164/437 |
| 2,847,739 | 8/1958 | Sylvester | 164/119 |
| 3,279,003 | 10/1966 | Yates | 164/119 X |
| 3,358,746 | 12/1967 | Crowe | 164/306 |
| 3,459,346 | 8/1969 | Tinnes | 164/337 X |

FOREIGN PATENT DOCUMENTS

| | | | |
|---|---|---|---|
| 63-278657 | 11/1988 | Japan | 164/306 |
| 2-229661 | 9/1990 | Japan | 164/337 |
| 2-229662 | 9/1990 | Japan | 164/337 |
| 2-229663 | 9/1990 | Japan | 164/337 |

*Primary Examiner*—J. Reed Batten, Jr.

*Attorney, Agent, or Firm*—Cushman Darby & Cushman, L.L.P.

[57] ABSTRACT

The core of the stalk is a metallic cylindrical body 1, such as a steel pipe. On an inner surface of the cylindrical body are layered a boron nitride coating 4, a mica sheet 6 which is airtight and thermal insulating, and a thermal insulating layer 7. On the outer surface of metallic cylindrical body 1 are layered a boron nitride coating 5, a wire gauze 10, a thermal insulating layer 12, a ceramic paper 13, and another boron nitride coating 15. The cylindrical body can be formed by a steel pipe is easily corroded and eroded by molten metal.

4 Claims, 2 Drawing Sheets

CASTING STALK

BACKGROUND OF THE INVENTION

1. Field of the Invention

The invention relates to a casting stalk used primarily for low-pressure casters.

2. Description of the Related Art

Conventional casting stalks that are extensively used for low pressure castings are of the thermally insulating type. They include various heat retaining layers formed on both inner and outer surfaces of a metallic cylindrical body, known as the "core". These layers protect the cylindrical body from molten metal so that the molten metal can be maintained at the desired temperature for casting.

In the conventional casting stalk, as described above, air can easily enter into the metallic cylindrical body and cause a problem with casting. When the cylindrical body is formed from a s steel pipe, there is an additional problem. The steel pipe is subject to corrosion and erosion by a molten bath of an aluminum alloy. If the molten aluminum alloy enters through cracks present on the outer thermally insulating member to reach the steel pipe, the steel pipe is gradually corroded and eroded. This, in turn, allows air to enter into the stalk during pressurized casting. This can make casting impossible when there is sufficient air leakage.

SUMMARY OF THE INVENTION

An object of the present invention is to provide a low-pressure casting stalk that has thermal insulation and that prevents leakage of air into the metallic cylindrical body.

The invention provides a casting stalk having a metallic cylindrical body with thermally insulating layers on both inner and outer surfaces of the cylindrical body, including its lower end. A thermally insulating sheet such as a mica sheet, a stainless sheet, or the like is interposed between the metallic cylindrical body and the thermally insulating layer on the inner side thereof.

The casting stalk constructed according to the present invention interposes an airtight and thermally insulating sheet between the metallic cylindrical body and the inner thermally insulating layer. This sheet prevents air from leaking into the metallic cylindrical body, thereby overcoming the problems associated with conventional casting stalks.

DETAILED DESCRIPTION OF THE PREFERRED EMBODIMENTS

Figure 1:
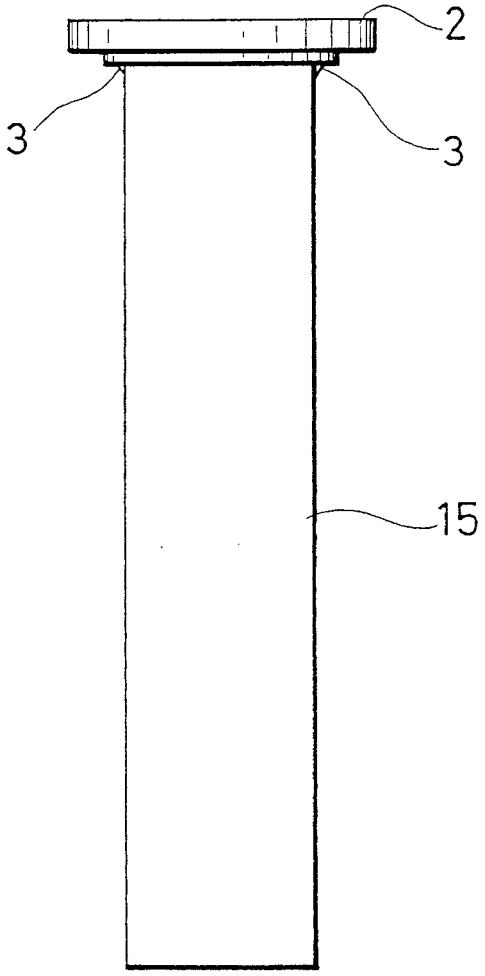
FIG. 1 is a side view of a casting stalk, according to the present invention.
Figure 3:
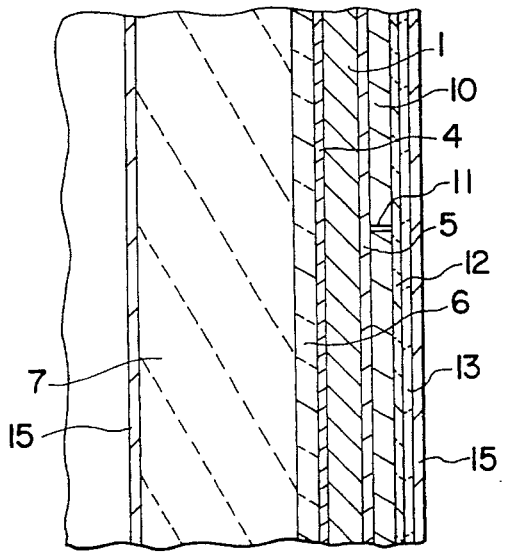
FIG. 3 is a further enlarged partially sectional view of FIG. 2.
Figure 4:
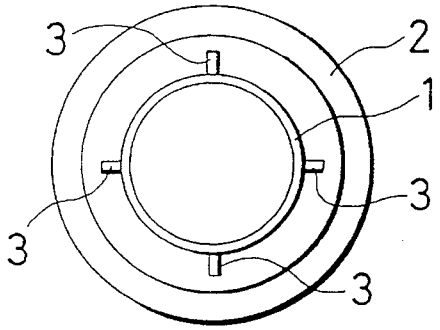
FIG. 4 is a plan view of the casting stalk.
Figure 5:
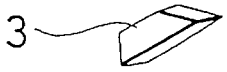
FIG. 5 is a perspective view of a reinforcing rib.
Figure 2:
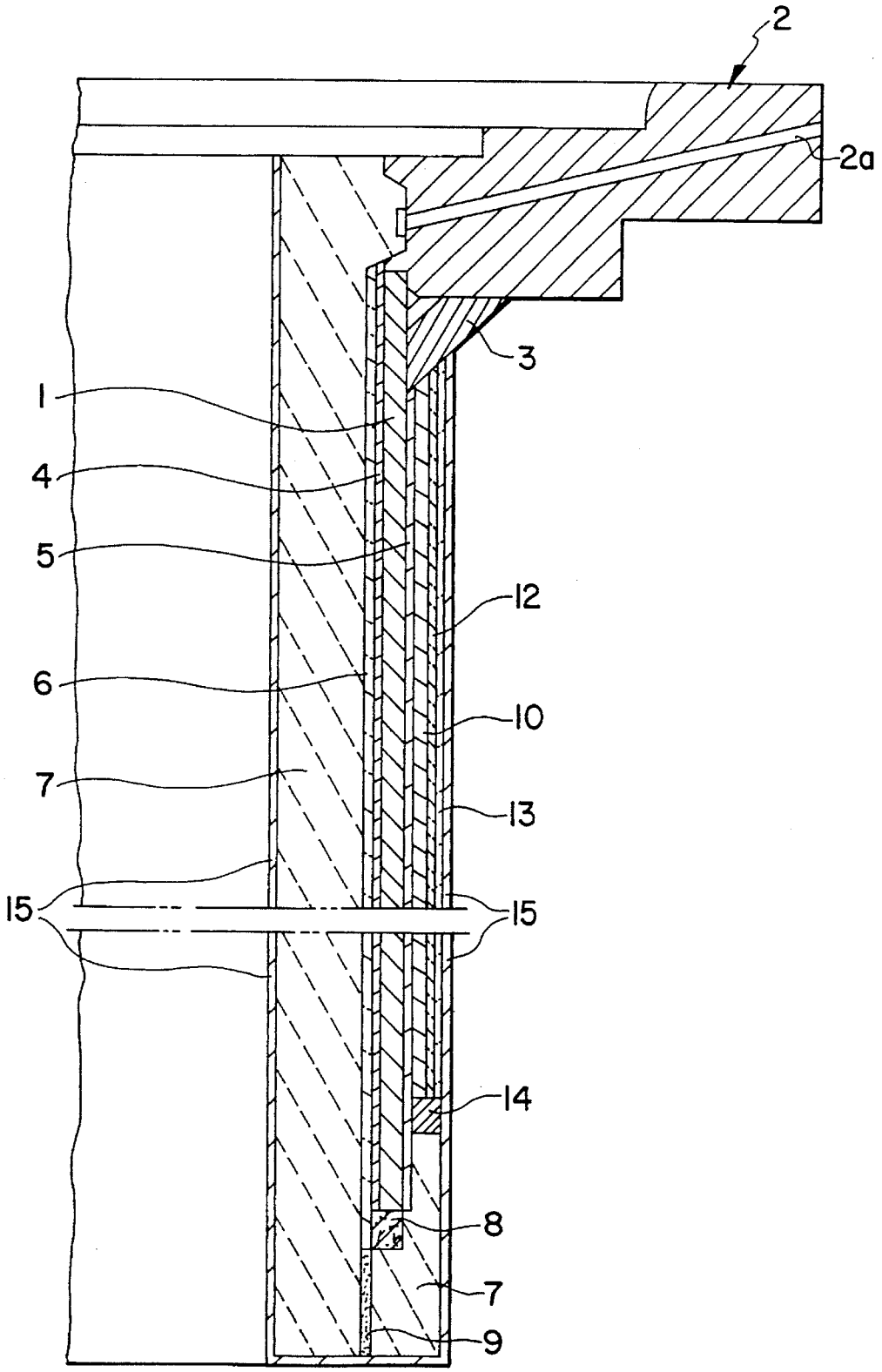
FIG. 2 is an enlarged partially sectional view of the casting stalk.

FIGS. 1 to 5 show an embodiment of a casting stalk according to the present invention.

A cylindrical body 1, serving as a core of the casting stalk, is made of metal. Cylindrical body 1 can, for example, be a thin-walled steel pipe. A flange 2 is argon welded to an opening of cylindrical body 1. An air vent 2*a* is provided in the flange. Certain advantages are derived from the use of argon welding. In the case of an offset stalk, the stalk is inserted obliquely and is flexed at high temperatures, allowing cracks to be easily produced at the structurally fragile interface between the cylindrical body and the flange. These cracks allow air to directly enter into the stalk. Argon welding improves the structural strength and airtightness of the stalk. In addition, reinforcing ribs 3 are rigidly welded outside the cylindrical body 1 and the flange 2.

The inner surface of body 1 is coated with a boron nitride layer 4. The outer surface of body 1 is coated with a boron nitride layer 5. Coating layers 4 and 5 are made from a boron nitride solution. As described above, in the BACKGROUND OF THE INVENTION section of this patent, the steel pipe forming the core of a casting stalk is easily corroded and eroded by A1 alloys. The use of boron nitride films improve corrosion and erosion resistance of the steel pipe.

A mica sheet 6 is lined over the boron nitride coating 4 that is formed on the inner side of the cylindrical body 1. A thick thermally insulating layer 7 is formed over the surface of the mica sheet 6. A refractory is used as the thermally insulating layer 7. The refractory is composed of wollastonite, alumina cement, polypropylene fiber, and alkali resistant glass fiber. The refractory is integrated with the cylindrical body by, e.g., setting the cylindrical body on a mold, curing the refractory after poured into the mold, unmolding the cylindrical body and the refractory to a drying and burning process.

In the embodiment illustrated (see FIG. 2), a compressible fiber blanket 8 is arranged on an end of the cylindrical body 1, and the refractory layer is formed so as to cover up the fiber blanket 8, so that elongation of the cylindrical body due to heat can be absorbed. Reference numeral 9 designates a pasted inorganic adhesive.

An expand metal or wire gauze 10 is formed over the boron nitride coating 5 on the outer side of body 1 through a welding fixture 11. A thermally insulating layer 12, formed over gauze 10, is composed of ceramic fiber, mica, and colloidal silica or colloidal aluminum. Further, two sheets of about 2.5 mm thick ceramic paper 13 are bonded onto the thermally insulating layer 12 with an inorganic binder. On the lower end of the ceramic paper 13 is an air stopper member 14 made of SUS304. A boron nitride coating 15 is formed over the entire surface of the insulated portion formed on the inner and outer sides of the cylindrical body 1.

The casting stalk construction according to this invention has significant operational advantages with respect to conventional casting stalks.

The thermally insulating layer 7 on the inner side of the metallic cylindrical body is formed of the refractory material made of wollastonite, alumina cement and fibers. Therefore, there is high heat retention and excellent thermal insulation. This prevents any significant reduction in temperature of the molten metal passing through the stalk. The thermally insulating layer 7 substantially prevents adhesion of the molten metal, together with the boron nitride coating over the surface thereof.

The thermally insulating layer on the outer side of the metallic cylindrical body is composed of the ceramic fiber, mica and the inorganic binder. It is a relatively simple coating and deposition process to form this layer.

Moreover, the surface of the thermal insulation formed by the coating and depositing process is not smooth, but the bonding of the ceramic paper provides the surface with smoothness, and the formation of the additional boron nitride coating thereon contributes to preventing the hot metal from adhering thereto.

As particularly described above, the interposition of the mica sheet provides airtightness and insulation between the metallic cylindrical body and the thermally insulating layer on the inner side of the cylindrical body. The use of this sheet prevents air from entering even if the metallic cylindrical body is corroded and eroded with time. For this purpose, the best suited material to be interposed is a mica sheet, since such material must be airtight, thermally insulating, non-wettable with respect to aluminum alloys and thin.

As a secondary effect, the construction according to the present invention including interposing the mica sheet contributes to reducing stress due to elongation differences between the metallic cylindrical body and the thermal insulating members. That is, it is proven that this arrangement is advantageous in preventing cracks of the thermal insulating members.

As described above, the casting stalk according to the invention has excellent thermal insulation and that can surely prevent leakage of air into the metallic cylindrical body can be obtained.

What is claimed is:

1. A casting stalk comprising:

a metallic cylindrical body;

an airtight and thermal insulating sheet formed on an inner surface of the metallic cylindrical body;

a first thermal insulating layer formed on the airtight and thermally insulating sheet;

a second thermal insulating layer formed on an outer surface of the cylindrical body; and a layer of boron nitride formed between the inner surface of the metallic cylindrical body and the airtight sheet.

2. A casting stalk comprising:

a metallic cylindrical body;

an airtight and thermal insulating sheet formed on an inner surface of the metallic cylindrical body;

a first thermal insulating layer formed on the airtight and thermally insulating sheet;

a second thermal insulating layer formed on an outer surface of the cylindrical body; and a layer of boron nitride formed between the outer surface of the metallic cylindrical body and the second thermal insulating layer.

3. A casting stalk according to claim 2 further comprising a wire gauze formed between the boron nitride on the outer surface of the metallic cylindrical body and the second thermal insulating layer.

4. A casting stalk according to claim 3 further comprising a ceramic paper layer formed on the second thermal layer.

* * * * *